US008424870B2

(12) United States Patent
Van Soest

(10) Patent No.: US 8,424,870 B2
(45) Date of Patent: Apr. 23, 2013

(54) SHEET HANDLING DEVICE

(75) Inventor: Hendrikus J. J. Van Soest, Helden (NL)

(73) Assignee: Oce-Technologies B.V., Venlo (NL)

( * ) Notice: Subject to any disclaimer, the term of this patent is extended or adjusted under 35 U.S.C. 154(b) by 0 days.

(21) Appl. No.: 11/284,892

(22) Filed: Nov. 23, 2005

(65) Prior Publication Data

US 2006/0181018 A1 Aug. 17, 2006

(30) Foreign Application Priority Data

Nov. 25, 2004 (EP) ..... 04106077

(51) Int. Cl.
*B65H 31/00* (2006.01)

(52) U.S. Cl.
USPC ..... 271/207; 271/270; 271/265.01; 271/266

(58) Field of Classification Search ..... 271/176, 271/207, 314, 265.01, 270
See application file for complete search history.

(56) References Cited

U.S. PATENT DOCUMENTS

| | | | | |
|---|---|---|---|---|
| 5,971,388 | A * | 10/1999 | Hattori et al. | 271/10.03 |
| 6,005,687 | A | 12/1999 | Kawashima et al. | |
| 7,347,419 | B2 * | 3/2008 | Sano et al. | 271/265.04 |

FOREIGN PATENT DOCUMENTS

| | | | |
|---|---|---|---|
| JP | 62-211263 | | 9/1987 |
| JP | 02292076 | A | 12/1990 |
| JP | 5124284 | A | 5/1993 |
| JP | 05319615 | A | 12/1993 |
| JP | 08-268615 | | 10/1996 |
| JP | 10319560 | A | 12/1998 |
| JP | 2000203744 | A | 7/2000 |
| JP | 2004-196483 | | 7/2004 |
| PA | 10029739 | A | 2/1998 |
| WO | WO-2004/041542 | A1 | 5/2004 |

* cited by examiner

*Primary Examiner* — Luis A Gonzalez
(74) *Attorney, Agent, or Firm* — Birch Stewart Kolasch & Birch, LLP

(57) ABSTRACT

A sheet handling device including a sheet transport path, a transport mechanism adapted to advance a sheet along the transport path with a non-uniform speed, and a discharge mechanism arranged at the transport path for taking over the sheet from the transport mechanism and discharging it into a tray, wherein the discharge mechanism is adapted to convey the sheet with a momentary speed that is different from that of the transport mechanism; and wherein a portion of the transport path between the transport mechanism and the discharge mechanism is curved along a buffer space to allow the sheet to bend within the buffer space and thereby to absorb the speed difference between the transport mechanism and the discharge mechanism.

8 Claims, 2 Drawing Sheets

SHEET HANDLING DEVICE

BACKGROUND OF THE INVENTION

The present invention relates to a sheet handling device including a sheet transport path, a transport mechanism adapted to advance a sheet along the transport path with a non-uniform speed, and a discharge mechanism arranged at the transport path for taking over the sheet from the transport mechanism and discharging it into a tray.

Ink jet printers, for example, often work on a scanning principle. That is, a carriage which includes a number of ink jet printheads reciprocates across a sheet. In each pass of the carriage, a number of pixel lines are printed on the sheet by means of the printheads which eject droplets of ink onto the sheet in accordance with image information supplied to the printheads. Between the printing passes, a transport mechanism advances the sheet by a suitable sheet advance step. In large format printers, the sheet advance movement is simultaneously performed in different parts of the printer. For example, while a leading part of a sheet has already been discharged onto the tray by the discharge mechanism, a rear part of the sheet may still be printed and advanced by the transport mechanism.

In order to achieve a high printing speed, the sheet advance movements have to be performed as quickly as possible. However, the printing quality depends on the accuracy of the sheet advance movements. When the sheet is simultaneously advanced by different transport means, one transport means may influence the accuracy of the movement of another transport means. For example, a discharge mechanism that discharges the printed sheet onto a tray may exert a force onto the sheet portion which is still being printed. This problem is even more pronounced in large format printers where the load that has to be exerted to move the sheet is higher. Moreover, the faster the sheet advance step is to be performed, the more power is required of the transport means. This leads to a higher load on the sheet and an increased noise generation.

From JP 62211263 A, a transport mechanism for discharging a sheet is known that transports the sheet from a pair of fixing rollers towards a discharge tray. A first driving roll is driven at a peripheral speed which is higher than that of the fixing rolls. Thereby, a waving of the sheet is reduced. However, the driving roll exerts a pulling force on the sheet during the fixing process.

JP 08268615 A also shows a transport mechanism for discharging a sheet that transports the sheet from a pair of fixing rollers towards a discharge tray. A sheet is held between the fixing rollers and first carrying rollers while a previous sheet is discharged by further carrying rollers at a speed which is higher than the paper carrying speed of the fixing rollers. The first carrying rollers are driven by means of a torque limiter, but nevertheless exert a pulling force on the sheet while it is held between the fixing rollers and the first carrying rollers.

From JP 2004196483 A, a transport mechanism is known which is adapted to appropriately maintain the amount of deflection of a sheet being conveyed along a curved path between two pairs of conveyance rollers. The amount of deflection of the sheet is measured by a pivotable contact arm, and the peripheral speed ratio of the two pairs of conveyance rollers is controlled to appropriately maintain the amount of deflection. However, a constant amount of deflection can only be maintained when the two pairs of conveyance rollers are continuously driven and their speed variations are small.

From WO 2004/041542 A1, a device for delivering a printed coupon is known wherein a web is advanced into a reserve chamber by a transport roller which participates in printing the web. The web is further advanced by a pair of discharge rollers at an discharge opening of the chamber. The transport rollers and the discharge rollers are operated to hold the web under tension against a resiliently pivotable arm during the printing process and to pull the web against a cutting edge after the printing is completed. Thus, a pulling force is exerted on the web during printing and also for cutting the web after printing.

SUMMARY OF THE INVENTION

It is an object of the present invention to provide a sheet handling device which allows a high printing speed and a high accuracy of sheet advance movements that are relevant to printing accuracy.

According to the present invention, this object is achieved by a sheet handling device of the type indicated above, wherein the transport mechanism is adapted to a stepwise advance of the sheet, wherein the discharge mechanism is adapted to convey the sheet with a momentary speed that is different from that of the transport mechanism; wherein a portion of the transport path between the transport mechanism and the discharge mechanism is curved along a buffer space to allow the sheet to bend within the buffer space and thereby to absorb the speed difference between the transport mechanism and the discharge mechanism, and wherein the transport mechanism and the discharge mechanism are adapted to be driven in such a way that a section of the sheet which is within the buffer space is mechanically stress-relieved, thus avoiding tension of the sheet between the transport mechanism and the discharge mechanism.

Accordingly, the sheet is buffered between the transport mechanism and the discharge mechanism. Thus, the sheet does not couple the transport mechanism to the discharge mechanism. In particular, the discharge mechanism does not exert a force on the transport mechanism through the sheet, because tension of the sheet between the transport mechanism and the discharge mechanism is avoided. For example, the buffer space is situated in the sheet transport path between a sheet support element and the discharge mechanism. The sheet support element supports the sheet during the printing process. The transport mechanism and the discharge mechanism are adapted to be driven in such a way that the sheet section in the buffer space is mechanically stress-relieved. For that purpose, the transport mechanism and the discharge mechanism may be driven in such a way that the length of the sheet section in the buffer space is always larger than a minimal length, unless the leading or the trailing edge of the sheet is yet within the buffer space.

In a preferred embodiment, the portion of the transport path comprises a curved guide plate, said guide plate passing in approximately a one-half turn around the buffer space. When the sheet is present in the buffer space and is conveyed by the discharge mechanism, the length of the sheet section that is accommodated in the buffer space will be reduced, and the sheet will be lifted from the curved guide plate. Then, the buffer space offers room for a further advance of the sheet by the transport mechanism.

Preferably, a path sensor is arranged at the buffer space. The path sensor is adapted to detect the distance between the portion of the transport path and the sheet when it is bent into the buffer space and a signal of the path sensor is input to a drive controller of the discharge mechanism. When the sheet traverses the buffer space, the path sensor is sensitive to the length of the sheet section that is within the buffer space. For example, the path sensor may detect a situation where the path of the sheet section within the buffer space has reached a certain minimum length, or the path sensor may detect a situation where the sheet section within the buffer space has reached a certain tension. In a straightforward example, the discharge mechanism is operated as long as a further reduction of the length of the sheet section between the sheet support element and the discharge mechanism is possible without inducing an unallowable tension in the sheet.

The transport mechanism is adapted to a stepwise advancement of the sheet. This applies to printers or copiers that work on a scanning principle as has been described above. For example, the discharge mechanism may also utilize a stepwise conveyance of the sheet. However, due to the buffering of the sheet, the discharge mechanism does not influence the sheet advance accuracy of the transport mechanism.

Preferably, the discharge mechanism is adapted to continuously convey the sheet. For example, the discharge mechanism may continuously advance the sheet while the transport mechanism stepwise advances the sheet over the sheet support element during the printing process. When the discharge mechanism continuously advances the sheet, the power of the discharge mechanism can be reduced as compared to the requirements for stepwise advancing the sheet. Moreover, a continuous discharging of the sheet into the tray is more convenient and gives an impression of a higher printing speed. Preferably, the speed of the discharge mechanism is adapted or adaptable to different printing modes and average sheet advance speeds of the transport mechanism for each printing mode. By continuously conveying the sheet, the acceleration forces that are applied to the discharge mechanism and to the sheet are significantly reduced. This has also the additional advantage of reducing the noise generation.

BRIEF DESCRIPTION OF THE DRAWINGS

A preferred embodiment of the present invention will now be described in conjunction with the drawings, in which.

DETAILED DESCRIPTION OF THE INVENTION

Figure 1:
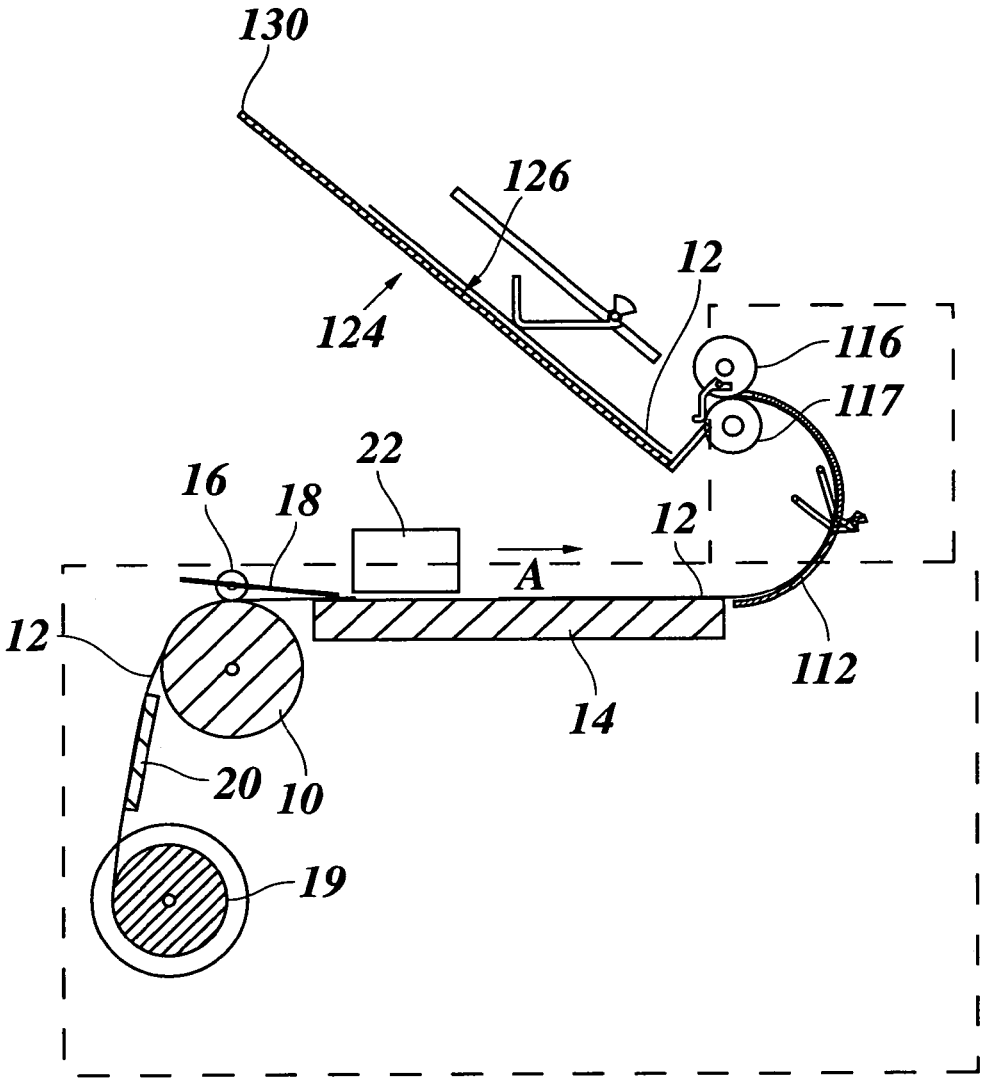
FIG. 1 is a schematic partial cross-sectional view of a printer.

As is shown in FIG. 1, an ink jet printer comprises a platen 10 which is intermittently driven to rotate in order to advance a sheet 12, e.g. a sheet of paper, in a direction indicated by an arrow A over the top surface of a sheet support plate 14. A number of transport rollers 16 are rotatably supported in a cover plate 18 and form a transport nip with the platen 10. The transport rollers 16 and the platen 10 form a transport mechanism for stepwise advancing the sheet 12. Thereby, the sheet 12, which is supplied from a reel 19 via a guide plate 20, is paid out through a gap formed between an edge of the cover plate 18 and the surface of the sheet support plate 14.

A carriage 22 which includes a number of ink jet print heads (not shown) is mounted above the sheet support plate 14 so as to reciprocate in a direction that is perpendicular to the plane of the drawing across the sheet 12. In each pass of the carriage 22, a number of pixel lines are printed on the sheet 12 by means of the print heads which eject droplets of ink onto the sheet in accordance with image information supplied to the print heads. For the sake of simplicity, guide and drive means for the carriage 22, ink supply lines and data supply lines for the print heads, and the like, have not been shown in the drawing.

The top surface of the sheet support plate 14 has a regular pattern of suction holes (not shown) through which the sheet 12 is drawn against the flat surface of the support plate 14 and is thereby held in a flat condition, especially in the area which is scanned by the carriage 22, so that a uniform distance between the nozzles of the printheads and the surface of the sheet 12 is established over the whole width of the sheet, and a high print quality can be achieved.

Figure 2:
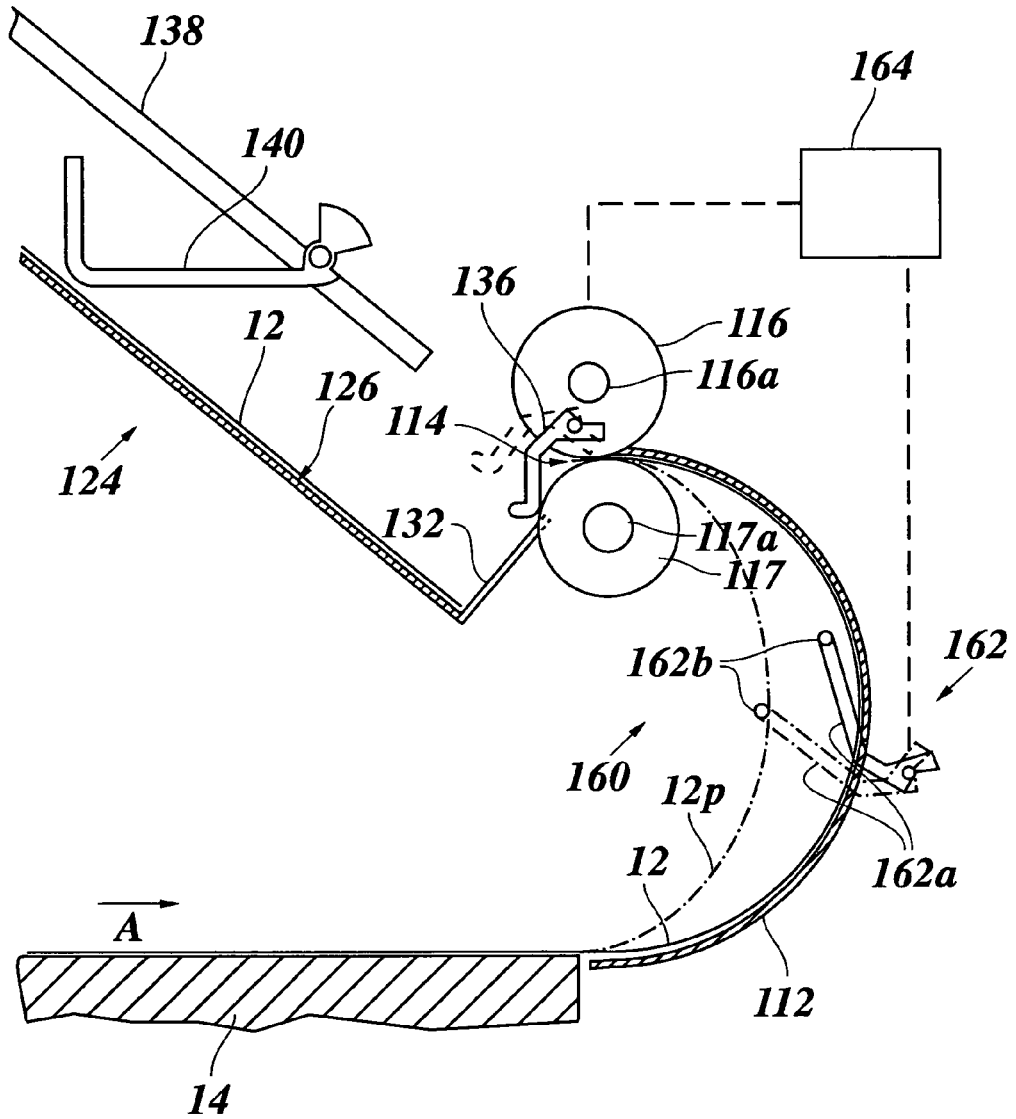
FIG. 2 shows a detail of a sheet handling device of the printer shown in FIG. 1.

The sheet 12 is further advanced along a curved guide plate 112 that turns the sheet upside down and reverses the transport direction of the sheet 12. As is shown in FIG. 1 and, in more detailed view, in FIG. 2, the sheet 12 is guided to a discharge nip 114 formed between a plurality of upper discharge rollers 116 and lower discharge rollers 117, that are mounted on common axles 116*a* and 117*a*, respectively. The discharge rollers 116, 117 form a discharge mechanism for continuously conveying the sheet, as will be described below.

From the discharge nip 114, the sheet 12 is discharged onto a tray 124. The tray 124 has a top surface 126 for supporting the sheets and has stops 132 at which the trailing edges of the sheets 12 will be aligned.

A discharge sensor 136 is arranged near the discharge nip 114 to indicate when the trailing edge of the sheet 12 has been discharged from the discharge nip 114. The discharge sensor 136 is of conventional design and comprises an arm that is pivotable about an axis.

A top frame member 138 of the tray 124 carries a tray-full sensor 140 which is also of conventional design containing an arm that is pivotably mounted on the frame member 138.

The curved guide plate 112 surrounds a buffer space 160 for the sheet 12 and passes in approximately a one-half turn around the buffer space 160. When a leading edge of the sheet 12 has reached the discharge rollers 116, 117, the discharge rollers 116, 117 engage the sheet 12 and advance the sheet 12 towards the tray 124. Thereby, sheet 12 may be lifted from the guide plate 112 when its trailing portion is still held on the sheet support plate 14. Thereby, a section 12*p* of the sheet 12 traverses the buffer space 160 on a bent path that has a shorter length than the path along the guide plate 112. The buffer space 160 is adapted to accommodate varying lengths of the sheet section 12*p* between the sheet support plate 14 and the discharge rollers 116, 117. Thereby, the sheet 12 is buffered so that speed differences between the transport rollers 16 and the platen 10 on the one side and the discharge rollers 116, 117 on the other side are absorbed, so that the sheet section 12*p* is mechanically stress-relieved. Thus, the discharge rollers 116, 117 will not exert a force on that part of the sheet that is held on the sheet support plate 14 nor on the platen 10 and the transport rollers 16.

At the guide plate 112, a path sensor 162 is mounted having a pivotable arm 162*a* that extends into the buffer space 160. At the end of the arm 162*a*, a rod 162*b* extends transverse to the plane of the drawing of FIG. 2. When the sheet 12 is lifted from the guide plate 112, the sheet 12 engages the rod 162*b* and pivots the arm 162*a*. Thereby, the path sensor 162 detects how far the sheet 12 is lifted from the guide plate 112, indicating the length of the path of the sheet section 12*p* that traverses the buffer space 160.

A signal of the path sensor is input to a drive controller 164 for the discharge rollers 116, 117. When the sheet is discharged by the discharge rollers 116, 117, the discharge rollers 116, 117 are continuously driven to convey the sheet 12 with a speed corresponding to an average advance speed of the sheet along the sheet support plate 14. Thereby, a continuous discharge movement of the sheet 12 is combined with the stepwise advancing of the sheet over the sheet support plate 14 during the printing process.

Due to the input of the path sensor 162 to the drive controller 164, the speed of the discharge rollers 116, 117 can be controlled to assure that the sheet section 12*p* is always lifted from the guide plate 112 in a degree so as to be mechanically stress-relieved. When the length of the path of the sheet section 12*p* becomes to short, the speed of the discharge rollers 116, 117 is reduced, and vice versa. Thereby, the sheet 12 is discharged onto the tray 124 with an almost constant speed.

The discharge rollers 116, 117 may be driven via free wheel clutches, so that they may temporarily rotate at a higher speed when the leading edge of a new sheet is pushed into the discharge nip.

Although an example has been described, where the sheet is stepwise advanced during the printing process and is continuously advanced through the discharge nip, the invention may be applied to any combination of continuous or stepwise discharge movements with continuous or intermittent movements during the printing process. In any case, the buffering of the sheet assures that the discharge rollers 116, 117 do not exert a force via the sheet section 12*p* onto that part of the sheet that is being printed at the sheet support plate nor on the transport rollers 16 nor the platen 10. Thereby, a high printing accuracy is achieved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A sheet handling device adapted to accommodate sheets of varying length comprising:

a sheet transport path;

a transport mechanism adapted to advance a sheet along the transport path with a non-uniform speed, wherein the transport mechanism is intermittently driven in order to obtain a stepwise advancement of the sheet, and a discharge mechanism arranged at the transport path for receiving the sheet from the transport mechanism and discharging it, wherein the transport mechanism advances the sheet in a stepwise manner, the discharge mechanism being controlled to convey the sheet with a momentary speed that is different from that of the transport mechanism; and a portion of the transport path between the transport mechanism and the discharge mechanism being curved to define a buffer space, wherein the buffer space is adapted to accommodate varying lengths of the sheet between the transport mechanism and the discharge mechanism, which allows the sheet to freely bend in an unrestricted manner within the buffer space and thereby absorb any speed difference between the stepwise advance of the transport mechanism and the discharge mechanism, a path sensor arranged at the buffer space, and a drive controller operatively associated with the path sensor and the discharge mechanism for inputting a signal from the path sensor to the discharge mechanism, wherein the path sensor detects a distance between a portion of the transport path and the sheet when it is bent into the buffer space whereby the discharge mechanism is driven due to the input from the path sensor to the drive controller, allowing the speed of the discharge mechanism to be controlled so that a section of the sheet which is within the buffer space is mechanically stress relieved, thus avoiding tension of the sheet between the transport mechanism and the discharge mechanism, said discharge mechanism continuously advancing the sheet while the transport mechanism stepwise advances the sheet, said portion of the transport path includes a curved guide plate passing about one-half turn around the buffer space, the transport mechanism and the discharge mechanism are controlled to have like average speeds, and a discharge sensor is operatively associated with the discharge mechanism and the drive controller.

2. The sheet handling device of claim 1, wherein the discharge mechanism is discharge rollers adapted to continuously convey the sheet.

3. A printer comprising the sheet handling device of claim 1.

4. The printer of claim 3, wherein said printer is an ink jet printer, and wherein the stepwise advancing movement of the sheet by the transport mechanism is adapted to a scanning ink jet printing process.

5. The sheet handling device of claim 1 wherein the path sensor is contactless.

6. The sheet handling device of claim 1, wherein the path sensor is mounted on the curved guide plate and includes a pivotable arm extending from outside of the buffer space into the buffer space.

7. The sheet handling device of claim 1, wherein the sheet transport path includes a gap portion formed between two flat surfaces that are arranged at an acute angle to each other.

8. A sheet handling device adapted to accommodate sheets of varying length comprising:

a sheet transport path;

a transport mechanism adapted to advance a sheet along the transport path with a non-uniform speed, wherein the transport mechanism is intermittently driven in order to obtain a stepwise advancement of the sheet, and a discharge mechanism arranged at the transport path for receiving the sheet from the transport mechanism and discharging it, wherein the transport mechanism advances the sheet in a stepwise manner, the discharge mechanism being controlled to convey the sheet with a momentary speed that is different from that of the transport mechanism; and a portion of the transport path between the transport mechanism and the discharge mechanism being curved to define a buffer space, wherein the buffer space is adapted to accommodate varying lengths of the sheet between the transport mechanism and the discharge mechanism, which allows the sheet to freely bend in an unrestricted manner within the buffer space and thereby absorb any speed difference between the stepwise advance of the transport mechanism and the discharge mechanism, a path sensor arranged at the buffer space, and a drive controller operatively associated with the path sensor and the discharge mechanism for inputting a signal from the path sensor to the discharge mechanism, wherein the path sensor detects a distance between a portion of the transport path and the sheet when it is bent into the buffer space whereby the discharge mechanism is driven due to the input from the path sensor to the drive controller, allowing the speed of the discharge mechanism to be controlled so that a section of the sheet which is within the buffer space is mechanically stress relieved, thus avoiding tension of the sheet between the transport mechanism and the discharge mechanism, said discharge mechanism continuously advancing the sheet while the transport mechanism stepwise advances the sheet, and said portion of the transport path includes a curved guide plate passing about one-half turn around the buffer space.

* * * * *